US008776713B2

(12) United States Patent
Shishido

(10) Patent No.: US 8,776,713 B2
(45) Date of Patent: Jul. 15, 2014

(54) WHISTLE

(75) Inventor: Hideomi Shishido, Hiroshima (JP)

(73) Assignee: Hideomi Shishido, Hiroshima-shi (JP)

( * ) Notice: Subject to any disclaimer, the term of this patent is extended or adjusted under 35 U.S.C. 154(b) by 307 days.

(21) Appl. No.: 13/167,485

(22) Filed: Jun. 23, 2011

(65) Prior Publication Data

US 2011/0315068 A1 Dec. 29, 2011

(30) Foreign Application Priority Data

Jun. 28, 2010 (JP) ..... 2010-146635

(51) Int. Cl.
*G10K 5/00* (2006.01)

(52) U.S. Cl.
USPC ..... 116/137 R; 446/204

(58) Field of Classification Search
USPC ..... 116/137 R; 446/204, 205, 206, 216; D10/119.3
See application file for complete search history.

(56) References Cited

U.S. PATENT DOCUMENTS

| | | | | |
|---|---|---|---|---|
| 696,814 | A * | 4/1902 | Hatch | 446/206 |
| 4,821,670 | A * | 4/1989 | Foxcroft et al. | 116/137 R |
| 5,086,726 | A | 2/1992 | Sharp | |
| 5,113,784 | A * | 5/1992 | Forselius | 116/137 R |
| 5,546,887 | A | 8/1996 | Cameron | |
| D409,939 | S | 5/1999 | Sharp et al. | |
| 7,428,878 | B2 * | 9/2008 | Kim | 116/137 R |
| 7,581,509 | B2 * | 9/2009 | Eventoff | 116/137 R |
| 2002/0017231 | A1 * | 2/2002 | Tanaka | 116/137 R |
| 2003/0116078 | A1 * | 6/2003 | Topman et al. | 116/137 R |
| 2008/0017097 | A1 | 1/2008 | Eventoff | |
| 2010/0261403 | A1 * | 10/2010 | Shishido | 446/204 |

FOREIGN PATENT DOCUMENTS

| | | | |
|---|---|---|---|
| EP | 0302645 | 2/1989 | |
| JP | 64-065598 A | 3/1989 | |
| WO | WO-2008/089533 | 7/2008 | |
| WO | WO 2009050827 A1 * | 4/2009 | G10K 5/00 |

OTHER PUBLICATIONS

"Extended European Search Report", in related European Application No. EP11171338, Report mailed Oct. 11, 2011, 4 pages.

* cited by examiner

*Primary Examiner* — R. A. Smith
(74) *Attorney, Agent, or Firm* — Michael A. Glenn; Perkins Coie LLP

(57) ABSTRACT

A whistle includes: an air supply opening; a first resonance chamber, a second resonance chamber and a third resonance chamber; a first air supply passage, a second air supply passage and a third air supply passage that branch from a common air supply passage; and a first sound emitting opening, a second sound emitting opening and a third sound emitting opening that emit sounds generated in the first resonance chamber, the second resonance chamber and the third resonance chamber, respectively. The first resonance chamber and the second resonance chamber are arranged side by side in a planar view. The third resonance chamber is disposed between the first resonance chamber and the second resonance chamber, as well as upside the first resonance chamber and the second resonance chamber. The first sound emitting opening, the second sound emitting opening and the third sound emitting opening are open upward.

1 Claim, 6 Drawing Sheets

WHISTLE

CROSS-REFERENCE TO RELATED APPLICATION

This application claims the benefit of Japanese Patent Application No. 2010-146635, filed on Jun. 28, 2010, the entire disclosure of which is incorporated by reference herein.

FIELD

This application relates to a whistle.

BACKGROUND

Whistles are widely used as an easy-to-use communication method using a sound in various fields, such as referees in various sport competitions, guarding, guiding and signaling in a place where many people gather, or training pets. Whistles are required to immediately deliver a sound to a person or an animal around thereby to alert the person or animal, according to each environment where the whistles are used. Therefore, it is required for a whistle to be able to be immediately and easily blown when needed. Meanwhile, for a listener, the sound is required to have an easy-to-hear sound quality and can be immediately recognized.

Pealess whistles can generate a sound with a higher frequency and a faster attack, compared with pea whistles including an oscillator within a resonance chamber. Therefore, pealess whistles are mainly used in a so-called professional field, such as traffic control and sport referees requiring an immediate communication and alerting. In such pealess whistles, whistles with three resonance chambers having different lengths become mainstream in order to exploit the aforementioned features. That is because similar but different three sound waves are interfered with one another thereby to generate a beat sound. Two sound waves can generate a beat sound, but three sound waves can generate a richer and clearer beat sound. The beat sound has an important role of making the sound of a whistle stand out from ambient noise. In order to generate an effective beat sound, it is important that respective sound waves are clearly generated, the frequencies of the respective sound waves are close and also the amplitudes of the respective sound waves are close. Since the amplitude of a generated sound wave depends on a width (cross-sectional area) of a resonance chamber, it is desired that the widths (cross-sectional areas) of the respective resonance chambers are identical.

As a pealess whistle with such three resonance chambers, the following whistles are disclosed in U.S. Pat. No. 5,086,726, Unexamined Japanese Patent Application KOKAI Publication No. H1-65598, and U.S. Design Pat. No. 409,939.

SUMMARY

A whistle disclosed in U.S. Pat. No. 5,086,726 includes three resonance chambers arranged in parallel on the same plane and three sound emitting openings that are open upward. However, since the three sound emitting openings are arranged adjacent to one another, a pressure of an air flow emitted from one of the sound emitting openings affects a sound wave emitted from its adjacent sound emitting opening, causing a problem of deafening sound waves to one another. In other words, independence of the respective resonance chambers cannot be secured. As a result, even if three resonance chambers and three sound emitting openings are provided, desired sound waves are not clearly emitted from the sound emitting openings and therefore a clear beat sound cannot be generated.

A whistle in U.S. Design Pat. No. 409,939 was disclosed later by the same inventor as that of U.S. Pat. No. 5,086,726, and includes three resonance chambers arranged in parallel on the same plane and three sound emitting openings, at least one of the sound emitting openings being open downward. In a whistle disclosed in Unexamined Japanese Patent Application KOKAI Publication No. H1-65598, two of three resonance chambers are arranged in parallel on a plane, remaining one resonance chamber is disposed below the two resonance chambers, and at least one of the three sound emitting openings is open downward. From a history of technology progress as will be described in detail, it is obvious that, detailed study of a product based on U.S. Pat. No. 5,086,726 found that the arrangement disclosed in U.S. Pat. No. 5,086,726 impairs independence of the respective resonance chambers thereby to prevent generation of clear sound waves, and these arrangements disclosed in Unexamined Japanese Patent Application KOKAI Publication No. H1-65598 and U.S. Design Pat. No. 409,939 are devised as a measure to solve the problem. Although these arrangements disclosed in Unexamined Japanese Patent Application KOKAI Publication No. H1-65598 and U.S. Design Pat. No. 409,939 secure independence of the respective resonance chambers, they have caused a new problem.

That is, a person blows a whistle while holding the whistle with its both sides gripped with one hand. At this time, the hand is situated ahead of and under the whistle. Therefore, a new problem occurs that a sound emitted from a sound emitting opening situated in a lower part of the whistle is blocked by the hand and thereby attenuated. Meanwhile, if a whistle is blown without being hold with a hand, a person blows the whistle while biting a mouthpiece with teeth and making a lower part of the whistle touch a lower jaw thereby to fix the position of the whistle. Likewise in this case, there is the same problem that the lower jaw blocks a sound emitted from the sound emitting opening situated in the lower part and the sound is attenuated. Since attenuation of a sound means attenuation of amplitude of a sound wave, the attenuated sound cannot generate a clear beat sound. After that, a whistle has not been disclosed that can simultaneously solve the two problems of securing independence of respective resonance chambers as well as avoiding blocking the sound emitting opening with a hand or a lower jaw.

The present invention has been made in light of the aforementioned matters. The objective of the present invention is to provide a whistle with three resonance chambers by which three resonate sound waves can be clearly generated without being deafened to one another, an emitted sound is not blocked by a hand or a lower jaw by a person who blows the whistle, thereby generating a clear and soothing beat sound. The whistle in the present invention also has an easy-to-use width without respective resonance chambers overly downsized.

A whistle according to the present invention includes:

an air supply opening through which a breath is blown into;

a first resonance chamber, a second resonance chamber and a third resonance chamber into which the breath blown into through the air supply opening flows through a common air supply passage, as well as a first air supply passage, a second air supply passage and a third air supply passage that branch from the common air supply passage; and a first sound emitting opening, a second sound emitting opening and a third sound emitting opening that emit sounds generated in the first resonance chamber, the second resonance chamber and the third resonance chamber, respectively, wherein the first resonance chamber and the second resonance chamber are arranged side by side in a planar view, the third resonance chamber is disposed between the first resonance chamber and the second resonance chamber, as well as upside the first resonance chamber and the second resonance chamber, the first sound emitting opening, the second sound emitting opening and the third sound emitting opening are open upward.

It is preferable that at least one of an outlet of the first air supply passage, an outlet of the second air supply passage and an outlet of the third air supply passage is disposed at a position relatively different from the positions of the other outlets in a longitudinal direction of the whistle.

It is also preferable that the outlet of the third air supply passage is disposed ahead of the outlet of the first air supply passage and the outlet of the second air supply passage.

It is also preferable that the first resonance chamber, the second resonance chamber and the third resonance chamber are arranged in such a way that respective central axes in a longitudinal direction of the first resonance chamber, the second resonance chamber and the third resonance chamber form an approximately upright triangle.

It is also preferable that a length of the first resonance chamber, a length of the second resonance chamber and a length of the third resonance chamber are different from one another.

It is also preferable that the third air supply passage is bent upward in such a way that a wall surface at the air supply opening side composing the third air supply passage forms a stopper for an upper lip.

A whistle according to the present invention includes three resonance chambers and three sound emitting openings to emit sound waves generated in the resonance chambers, respectively, the three sound emitting openings being open upward. Since independence of these three resonance chambers is secured, three clear sound waves are generated. Moreover, since all of the three sound emitting openings are open upward, even if a person grips both sides of the whistle while blowing the whistle, a hand does not block a travel of a sound emitted from any of the sound emitting openings, thereby generating a clear and soothing beat sound.

Since the whistle according to the present invention has the three resonance chambers arranged in a triangular shape, it has almost the same width as that of a whistle with two resonance chambers and therefore has an advantage of ease of use.

BRIEF DESCRIPTION OF THE DRAWINGS

A more complete understanding of this application can be obtained when the following detailed description is considered in conjunction with the following drawings, in which.

DETAILED DESCRIPTION

Figure 1:
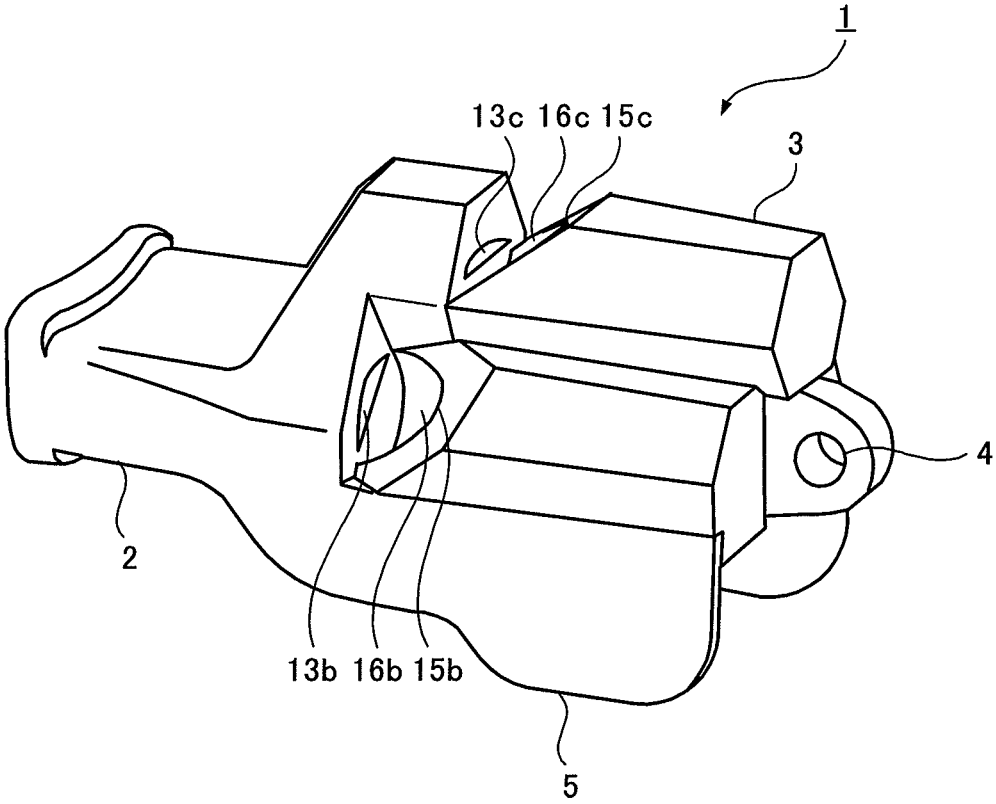
FIG. 1 is a perspective view illustrating an appearance of a whistle according to an embodiment of the present invention.

A whistle according to the present embodiment will be described hereinbelow with reference to drawings. A whistle 1 according to the present embodiment is mainly composed of: a mouthpiece section 2 that includes a common air supply passage 12 and three air supply passages 12*a*, 12*b*, 12*c* that branch from the common air supply passage 12; and a body section 3 that includes three resonance chambers 14*a*, 14*b*, 14*c* and three sound emitting openings 16*a*, 16*b*, 16*c* that are openings formed in part of the resonance chambers 14*a*, 14*b*, 14*c*, respectively, as illustrated in FIGS. 1 to 5. The body section 3 has a strap hole 4 to thread a strap for holding the whistle 1 by wearing the whistle 1 around a neck and the like. Moreover, from both lower sides of the body section 3, a finger grip section 5 projects downward, the finger grip section 5 being gripped with a hand for holding the whistle 1.

The mouthpiece section 2 has an air supply opening 11 which has an elongated rectangular shape and into which a breath is blown. The mouthpiece section 2 includes the common air supply passage 12, first air supply passage 12*a*, second air supply passage 12*b* and third air supply passage 12*c* that make the breath blown through the air supply opening 11 pass through and flow into the first resonance chamber 14*a*, the second resonance chamber 14*b* and the third resonance chamber 14*c*.

The common air supply passage 12 branches halfway into the first air supply passage 12*a*, the second air supply passage 12*b* and the third air supply passage 12*c*. The breath flown into the first air supply passage 12*a*, the second air supply passage 12*b* and the third air supply passage 12*c* is emitted from a first air supply passage outlet 13*a*, a second air supply passage outlet 13*b* and a third air supply passage outlet 13*c*, respectively.

The body section 3 includes the first resonance chamber 14*a*, the second resonance chamber 14*b* and the third resonance chamber 14*c*, each being formed as a cylindrical open space. The breath emitted from the first air supply passage outlet 13*a*, the breath emitted from the second air supply passage outlet 13*b* and the breath emitted from the third air supply passage outlet 13*c* flow into the first resonance chamber 14*a*, second resonance chamber 14*b* and third resonance chamber 14*c*, respectively.

In each of the first resonance chamber 14*a*, the second resonance chamber 14*b* and the third resonance chamber 14*c*, part of its inlet is notched obliquely relative to a central axis of the respective resonance chambers, forming a first sound emitting opening 16*a*, a second sound emitting opening 16*b* and a third sound emitting opening 16*c*, respectively.

The breath blown into impinges against edges 15*a*, 15*b*, 15*c*, each generating a sound, and part of the sound being amplified due to a resonance effect, selectively according to a frequency depending on lengths of the first resonance chamber 14*a*, the second resonance chamber 14*b* and the third resonance chamber 14*c*. The resulting sound waves are emitted outside from the first sound emitting opening 16*a*, the second sound emitting opening 16*b* and the third sound emitting opening 16*c*, respectively.

The sound emitting openings 16*a*, 16*b*, 16*c* all are open upward. Therefore, a travel of each of the emitted sounds cannot be blocked with a hand of a person who grip the whistle to blow.

Next, a configuration, operation and effect of the whistle 1 will be described in more detail. The first resonance chamber 14*a* and the second resonance chamber 14*b* are arranged approximately in parallel in a planar view. The third resonance chamber 14*c* is disposed between the first resonance chamber 14*a* and the second resonance chamber 14*b*, as well as upside the first resonance chamber 14*a* and the second resonance chamber 14*b*.

Figure 2:
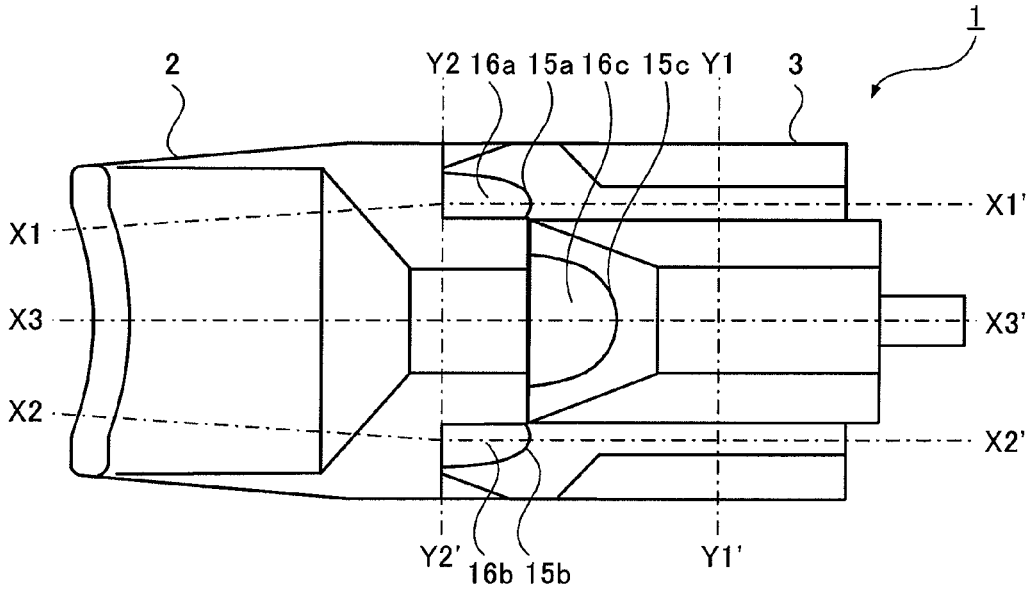
FIG. 2 is a plane view of a whistle according to an embodiment of the present invention.
Figure 3A:
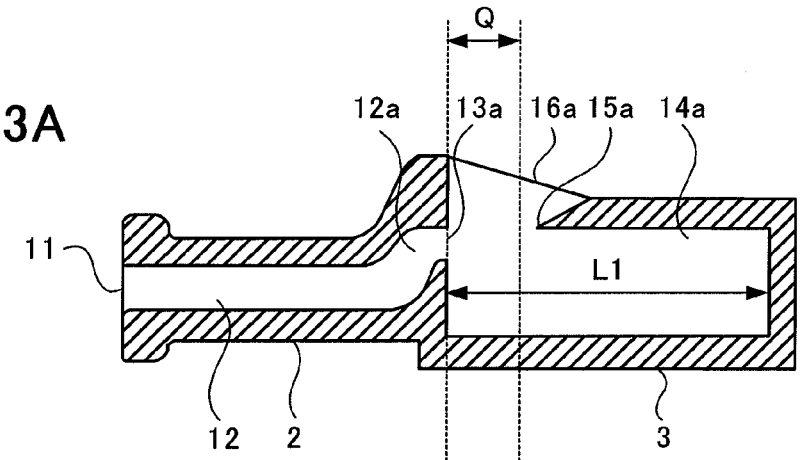
FIG. 3A is a cross-sectional view taken on line X1-X1' of FIG. 2.
Figure 3B:
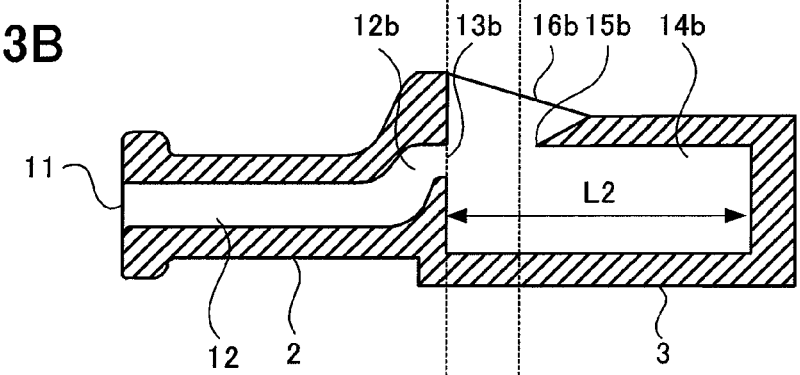
FIG. 3B is a cross-sectional view taken on line X2-X2' of FIG. 2.
Figure 3C:
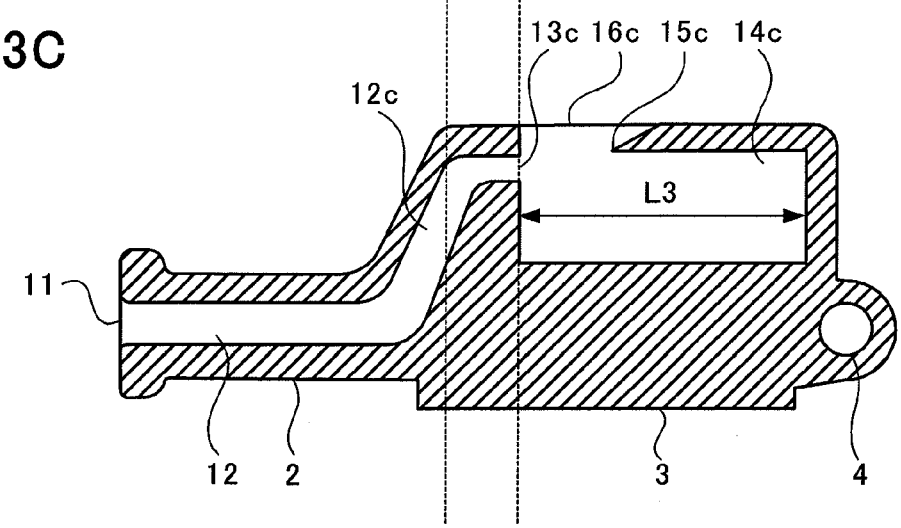
FIG. 3C is a cross-sectional view taken on line X3-X3' of FIG. 2.

FIGS. 3A, 3B and 3C illustrate cross-sectional views taken on lines X1-X1', X2-X2' and X3-X3' of FIG. 2, respectively. A length L1 of the first resonance chamber 14*a*, a length L2 of the second resonance chamber 14*b* and a length L3 of the third resonance chamber 14*c* are different from one another. In the present embodiment, the relationships of the respective lengths are as follows: the length L1 of the first resonance chamber 14*a*>the length L2 of the second resonance chamber 14*b*>the length L3 of the third resonance chamber 14*c*.

A tone of a sound generated in a resonance chamber varies depending on a frequency of a sound wave; a resonance chamber with a shorter length generates a sound wave with a higher frequency, generating a high pitch sound whereas a resonance chamber with a longer length generates a sound wave with a lower frequency, generating a low pitch sound. In the whistle according to the present embodiment, pitches of sounds generated in the respective resonance chambers are as follows: third resonance chamber 14*c*>second resonance chamber 14*b*>first resonance chamber 14*a*. Since three different pitches of a relatively high pitch sound, middle pitch sound and low pitch sound are emitted, their sound waves interfere with one another, generating a beat sound.

In one example, specific lengths of the resonance chamber 14*a*, 14*b*, 14*c* that generate a sound suitable for a referee in a sport competition are L1=22.7 mm, L2=21.4 mm, L3=20.0 mm, respectively. In this case, the emitted sound is a sound in which the sounds from the respective resonance chambers are added with a piercing beat sound and is easy for a listener to differentiate from other sounds even in a noisy gymnasium.

Figure 4:
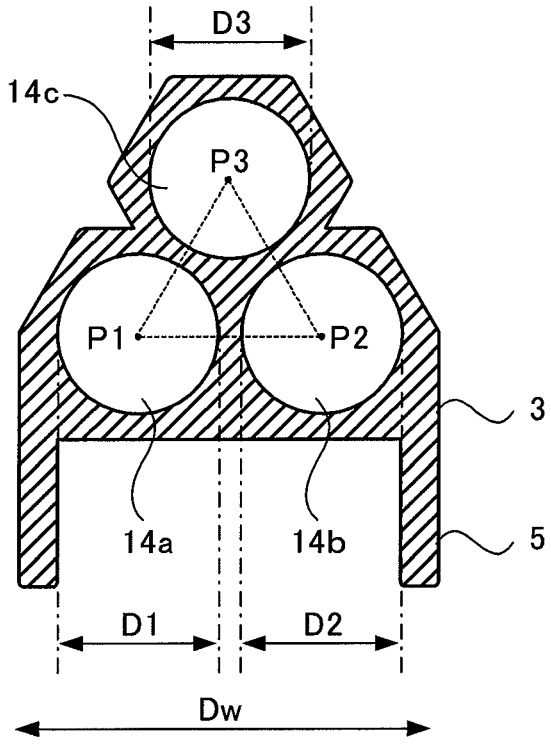
FIG. 4 is a cross-sectional view taken on line Y1-Y1' of FIG. 2.

FIG. 4 illustrates a cross sectional view of taken on line Y1-Y1' of FIG. 2. In FIG. 4, a diameter D1 of the first resonance chamber 14*a*, a diameter D2 of the second resonance chamber 14*b* and a diameter D3 of the third resonance chamber 14*c* are set to be the same. As is clear from the acoustic theory, a magnitude of a sound depends on the amplitude of a sound wave. Since, as we can see from an example of wind instruments, the amplitude of a resonant sound wave is restricted by a cross-sectional area of a resonance chamber, a resonance chamber with a larger diameter generates a sound wave with a larger amplitude, thereby emitting a relaxed and loud sound without a distortion. In the whistle 1, since diameters D1, D2, D3 of the first resonance chamber 14*a*, the second resonance chamber 14*b* and the third resonance chamber 14*c* all are the same, magnitudes, that is, amplitudes of sounds generated in the respective resonance chambers 14*a*, 14*b*, 14*c* are approximately the same. Here, the diameter can be 5 to 10 mm.

As described above, a beat sound is generated in such a way that a plurality of sound waves, each having a different frequency, interfere with one another and distort a composite waveform. On the assumption that sounds with different tones and different magnitudes are simultaneously emitted, a small sound has a sound wave with a small amplitude and a large sound has a sound wave with a large amplitude. In this way, if the amplitude of the other sound wave is smaller compared with the amplitude of one sound wave, an interference effect of these sound waves is small. That is, since a distortion of a composite waveform generated by interference of these sound waves with different amplitudes is small, a clear beat sound cannot be generated.

However, the whistle 1 according to the present embodiment, diameters of the first resonance chamber 14*a*, the second resonance chamber 14*b* and the third resonance chamber 14*c* are identical. Accordingly, the resonance chambers 14*a*, 14*b*, 14*c* generate sound waves having almost the same amplitude and a bit different frequencies. Therefore, sounds having approximately the same volume but a bit different tones are emitted. Therefore, sounds emitted from the respective sound emitting openings 16*a*, 16*b*, 16*c* effectively interfere with one another, increasing a distortion of a waveform of a composite sound wave thereby to generate a clear and soothing beat sound.

Figure 5:
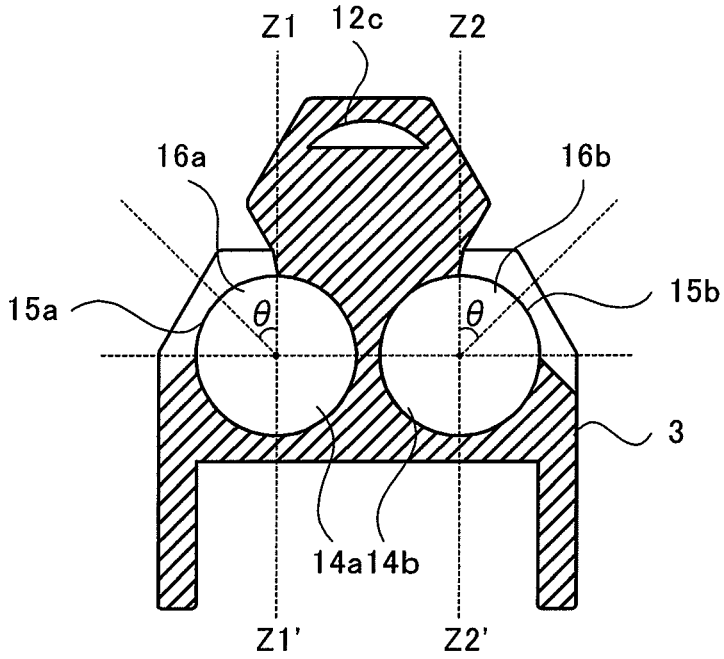
FIG. 5 is a cross-sectional view taken on line Y2-Y2' of FIG. 2, seen from a mouthpiece side.

FIG. 5 illustrates a cross-sectional view taken on line Y2-Y2' of FIG. 2. The first sound emitting opening 16*a* is open toward the left side and obliquely upward (in a direction inclined toward a lateral side by an angle θ relative to Z1-Z1' axis in FIG. 5). The second sound emitting opening 16*b* is also open toward the right side and obliquely upward (in a direction inclined toward a lateral side by an angle θ relative to Z2-Z2' axis in FIG. 5). The angle θ is preferably 30 to 60° and more preferably 40 to 50°. If the angle θ is less than 30°, a sound impinges against a wall composing the third resonance chamber 14*c* and is attenuated. If the angle θ is more than 60°, a finger may block the first sound emitting opening 16*a* and the second sound emitting opening 16*b* when the whistle is blown with its finger grip section 5 gripped with fingers. In this configuration, the three sound emitting openings 16*a*, 16*b*, 16*c* emit sounds in a radial pattern, as viewed in a cross section.

When the first sound emitting opening 16*a*, the second sound emitting opening 16*b* and the third sound emitting opening 16*c* are open inclined and obliquely upward relative to central axes P1, P2, P3 in the respective resonance chambers, in this way, the first edge 15*a*, the second edge 15*b* and the third edge 15*c* are formed larger. The larger the edges 15*a*, 15*b*, 15*c* are, the more a blown breath tends to generate an eddy, as a result, the more a sound wave tends to be generated.

Returning to cross-sectional views of FIGS. 3A, 3B, 3C, the third air supply passage outlet 13*c* is situated by a distance Q ahead of the first air supply passage outlet 13*a* and the second air supply passage outlet 13*b*, that is, closer to the strap hole 4. This distance Q is 2 to 10 mm, preferably 3 to 7 mm. In this specification, the term "ahead" means a direction facing a listener when the whistle 1 is blown, that is, a side opposite to the air supply opening 11 in a longitudinal direction of the whistle 1.

If the third air supply passage outlet 13*c* is on the same plane as the first air supply passage outlet 13*a* and the second air supply passage outlet 13*b*, the first sound emitting opening 16*a* and the second sound emitting opening 16*b* are disposed at bilaterally symmetrical positions of the third sound emitting opening 16*c* in a fan-like configuration. In such a configuration, the respective sound emitting openings 16*a*, 16*b*, 16*c* become a connected space, and therefore cannot maintain their independence. This causes the respective sound emitting openings to lose their independence, as well as to have a significant effect on sound generation independence of the respective resonance chambers, thereby inhibiting a normal sound generation. One of the causes for this is that wind emitted from one of the air supply passage outlet flows through the adjacent sound emitting opening into the adjacent resonance chamber, and an air current emitted from one of the sound emitting openings deafens a sound wave emitted from the adjacent resonance chamber through the adjacent sound emitting opening.

A simple example that concretely shows this problem is a product (product name: ACME TORNADE) manufactured based on U.S. Pat. No. 5,086,726. In this product, three resonance chambers are arranged side by side in a planar view, as well as three air supply passage outlets and three sound emitting openings are arranged side by side, respectively, in a plane view. In such an arrangement, the respective sound emitting openings become a space that is connected in one line, making it difficult to maintain independence of the respective sound emitting openings, and, as a result, a resonant sound wave generated in each of the resonance chambers cannot be emitted without being affected with one another. Especially, a resonant sound wave generated in a central resonance chamber is deafened by a pressure of an air flow emitted from sound emitting openings situated on the right and left of the central resonance chamber, and therefore a normal sound wave cannot be generated. This is proved by that a blown sound is almost the same between when the central sound emitting opening is blocked with a shield and when it is not blocked. That is, the three resonance chambers exist, but at least one of them does not work normally. Accordingly, a clear and soothing beat sound is not generated. It is obvious that in order to solve this problem a central air supply passage outlet and sound emitting opening are disposed downward in the whistles disclosed in Unexamined Japanese Patent Application KOKAI Publication No. H1-65598 and U.S. Design Pat. No. 409,939. In these whistles, independence of the respective resonance chambers can be maintained, but a new problem occurs that the sound emitting opening disposed downward is blocked with a hand gripping a whistle, thereby attenuating a sound, as described above. Moreover, a sound wave attenuated by blocking with a hand has a smaller amplitude and therefore cannot generate a clear beat sound.

In order to solve a problem of independence of the aforementioned three resonance chambers, according to the present embodiment, the third air supply passage outlet 13*c* is arranged to be shifted ahead (toward the strap hole 4) relative to the first air supply passage outlet 13*a* and the second air supply passage outlet 13*b*. By this arrangement, part of the mouthpiece section 2 that composes the third air supply passage 12*c* juts forward to become a dividing wall to divide between the third sound emitting opening 16*c* and the first sound emitting opening 16*a*, and between the third sound emitting opening 16*c* and the second sound emitting opening 16*b*, respectively. In addition, by this arrangement, since the third sound emitting opening 16*c* is situated ahead, independence of the respective resonance chambers 14*a*, 14*b*, 14*c* and sound emitting openings 16*a*, 16*b*, 16*c* can be secured, thereby ensuring generation of sound waves having three different tones. Such a configuration of the respective resonance chambers 14*a*, 14*b*, 14*c* can be realized by one of effects of arranging central axes of the respective resonance chambers 14*a*, 14*b*, 14*c* in an approximately upright triangle, which will be described later.

As described above, the whistle 1, the first sound emitting opening 16*a* and the second sound emitting opening 16*b* are situated closer to the air supply opening 11 than the third sound emitting opening 16*c*, and all of the sound emitting openings 16*a*, 16*b*, 16*c* are spaced apart. Moreover, all of the three sound emitting openings 16*a*, 16*b*, 16*c* are open at different angles. Therefore, independence of the respective resonance chambers can be secured, three clear resonant sound waves can be generated, and a clear and soothing beat sound can be exhibited, thereby generating a sound volume and tone that is easy to listen to.

In the above, the embodiment in which the third air supply passage outlet 13*c* is disposed closer to the strap hole 4 than the first air supply passage outlet 13*a* and the second air supply passage outlet 13*b* has been explained, but is not limited to this. For example, the third air supply passage outlet 13*c* may be situated closer to the air supply opening 11 than the first air supply passage outlet 13*a* and the second air supply passage outlet 13*b*. The first air supply passage outlet 13*a*, the second air supply passage outlet 13*b* and the third air supply passage outlet 13*c* may be arranged in this order from the air supply opening 11 side, or the third air supply passage outlet 13*c*, the second air supply passage outlet 13*b* and the first air supply passage outlet 13*a* may be arranged in this order from the air supply opening 11 side.

Further advantages will be described in the case where the third air supply passage outlet 13*c* is situated closer to the strap hole 4 than the first air supply passage outlet 13*a* and the second air supply passage outlet 13*b*. In the case where the third air supply passage outlet 13*c* is situated at the same position of the first air supply passage outlet 13*a* and the second air supply passage outlet 13*b*, if the whistle 1 is downsized by shortening an entire length of the whistle 1, the third air supply passage outlet 13*c* that juts upward is situated at the side of the air supply opening 11, making shorter a length of the mouthpiece section 2 that can be held in the mouth of a person who blows the whistle, as a result, making it difficult to hold the mouthpiece in mouth and deal with it. Meanwhile, if the length of the mouthpiece section 2 that is easy to be held in mouth is secured, an entire length of the whistle 1 becomes longer, and the whistle 1 cannot be downsized.

However, in the whistle 1 according to the present embodiment, as described above, the third air supply passage outlet 13*c* is situated closer to the strap hole 4 by a distance Q than the first air supply passage outlet 13*a* and the second air supply passage outlet 13*b*. In other words, the third air supply passage outlet 13*c* juts forward (toward the strap hole 4) from the first air supply passage outlet 13*a* and the second air supply passage outlet 13*b*, thereby securing a length of the mouthpiece section 2 that is easy to be held in the mouth of a person who blows the whistle.

Since the third air supply passage 12*c* is bent upward, a wall surface composing the third air supply passage 12*c* forms a stopper for the upper lip.

Returning to a cross sectional view of FIG. 4, the whistle 1 according to the present embodiment, the first resonance chamber 14*a* and the second resonance chamber 14*b* are arranged in parallel, and the third resonance chamber 14*c* is disposed between the first resonance chamber 14*a* and the second resonance chamber 14*b*, and upside the first resonance chamber 14*a* and the second resonance chamber 14*b*, that is, they are arranged in a triangular shape. This reduces a width Dw of the whistle 1 even though the whistle 1 includes three resonance chambers.

For example, if a diameter of the resonance chamber is 8 mm, a thickness of a dividing wall between the resonance chambers and a thickness of a side wall of the whistle is 2 mm respectively, a width Dw of the whistle 1 is 22 mm. Meanwhile, three resonance chambers having the same 8 mm diameters are arranged in parallel on the same plane, a width of the whistle is 30 mm. In the whistle 1, the three resonance chambers are arranged in a triangular shape, thereby reducing a width by 8 mm, compared with the whistle in which three resonance chambers are arranged in parallel on the same plane. This also can reduce a weight of the whistle. Downsizing and reducing a weight of a whistle is highly demanded for a referee for a fast sport such as basketball and soccer.

Moreover, the first resonance chamber 14*a*, the second resonance chamber 14*b* and the third resonance chamber 14*c* are arranged in such a way that central axes of P1, P2, P3 in a longitudinal direction of the respective resonance chambers 14*a*, 14*b*, 14*c* form an approximately upright triangular shape. This arrangement in a triangular shape is excellent in volumetric efficiency, realizing downsizing the whistle 1 without overly downsizing the three resonance chambers 14*a*, 14*b*, 14*c*.

A commonly-used whistle which has been distributed has a body width and a mouthpiece width of 18 to 23 mm whereas a product manufactured and marketed (product name: ACME TORNADE2000) based on U.S. Design Pat. No. 409,939 has a body width of 28 mm and a mouthpiece width of 22 mm, which is wider than a commonly-used whistle, and more difficult to grip with hand and hold in mouth, therefore in fact is not distributed. This suggests that a user of a whistle requires a smaller whistle.

Moreover, importance of reducing a body width of a whistle can be concretely explained from a product based on U.S. Pat. No. 5,086,726 and subsequent products. In the whistle disclosed in U.S. Pat. No. 5,086,726, three resonance chambers are arranged in parallel on the same plane, and main explanation drawings (FIGS. 2, 7, 8) in U.S. Pat. No. 5,086,726 illustrate that the respective resonance chambers have the same widths. However, as an actual product (product name: ACME TORNADE) is manufactured according to another embodiment illustrated in FIG. 12, that is, an embodiment in which a size of a central resonance chamber is reduced compared with the resonance chambers situated on the right and left of the central resonance chamber. Specific dimensions of the product are as follows: a width of resonance chambers on the right and left is 6 mm, a width of a central resonance chamber is 3 mm, and a width of a body is 20 mm. This means that if a width of the central resonance chamber is set to be 6 mm that is the same width of the resonance chambers on the right and left, a width of the body becomes 24 mm, which is contrary to a desire of downsizing a whistle. This also suggests that downsizing by millimeter unit is important for a whistle.

Meanwhile, as obvious from the acoustic theory, a magnitude of a resonant sound is proportional to an amplitude of a sound wave, and the amplitude is proportional to a size of a resonance chamber. Accordingly, in a whistle in which cross sections of three resonance chambers arranged in parallel on the same plane are made smaller and the width is reduced, amplitudes of sound waves generated in the respective resonance chambers are made smaller, and as a result emitted sounds are also made smaller. As described above, in the aforementioned product (product name: ACME TORNADO) commercialized by making a width of a central resonance chamber smaller than widths of resonance chambers on the right and left on the basis of U.S. Pat. No. 5,086,726, reduction of a width can be realized, but a width of the central resonance chamber is also reduced. Therefore, an amplitude of a resonant sound wave generated in the central resonance chamber is smaller than amplitudes of resonant sound waves generated in the resonance chambers on the right and left, naturally reducing an interference effect. Therefore, a clear beat sound cannot be generated.

The above examples also show that although a whistle that generates a clear beat sound and is small is needed, it is difficult to realize such a whistle since the clear beat sound and downsizing has a trade-off relationship.

However, in the whistle 1 according to the present embodiment, three resonance chambers 14*a*, 14*b*, 14*c*, having approximately the same cross-sectional area and different lengths are arranged in a triangular shape. Therefore, the respective resonance chambers have the same cross-sectional areas without overly reducing the cross-sectional areas, as well as reducing a width of the whistle 1. By disposing the third air supply passage outlet 13*c* ahead of the first air supply passage outlet 13*a* and second air supply passage outlet 13*b*, independence of the resonance chambers 14*a*, 14*b*, 14*c* is secured. Moreover, all of the sound emitting openings are disposed upward and have no problem that a sound wave is attenuated by blocking the sound emitting opening with a hand holding the whistle. Accordingly, all of the sound emitting openings emit clear sound waves, thereby generating a clear beat sound. As described above, a whistle 1 is realized which is easy for a person who blows the whistle to hold in mouth, easy for him/her to grip with a hand, and whose clear beat sound is easy for a listener to listen to, without sacrificing a clear beat sound and a downsized whistle.

Figure 6:
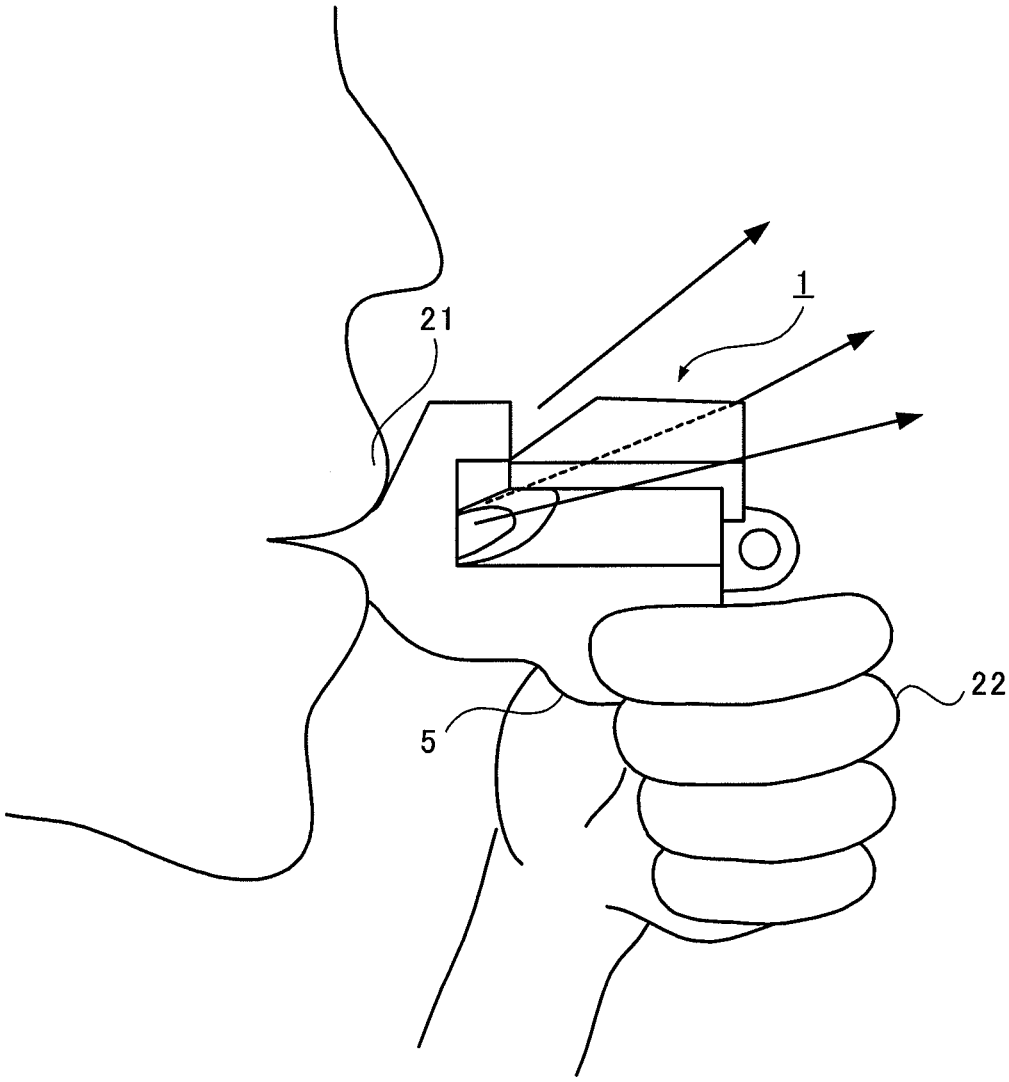
FIG. 6 is a schematic view illustrating a state where a whistle according to an embodiment of the present invention is blown.

FIG. 6 illustrates a state where the whistle 1 is being blown. A person usually holds and blows the whistle while gripping both sides of the finger grip section 5 of the whistle 1 with a thumb and a forefinger and holding the mouthpiece section 2 in mouth.

At this time, a hand 22 is situated ahead of and under the whistle 1. In such a usual way to blow, if a sound emitting opening is open downward, as in, e.g., Unexamined Japanese Patent Application KOKAI Publication No. H1-65598 and U.S. Design Pat. No. 409,939, a travel of a sound emitted from the sound emitting opening is blocked with the hand and as a result the sound cannot reach to the listener.

However, in the whistle 1 according to the present embodiment, since all of the sound emitting openings 16*a*, 16*b*, 16*c* are open upward, sounds emitted from the respective sound emitting openings 16*a*, 16*b*, 16*c* reach to the listener without being blocked with a hand, as illustrated by arrows.

In the use for a referee for a sport that requires a quick movement, the referee has to hold the whistle in mouth on the instant and blow it. In such a case, if the whistle disclosed in any of Unexamined Japanese Patent Application KOKAI Publication No. H1-65598 and U.S. Design Pat. No. 409,939 is used, since their top surface is flat or only has a slight projection, the whistle may be deeply held in mouth, blocking a sound emitting opening, thereby preventing blowing when needed.

Meanwhile, in the whistle 1 according to the present embodiment, since the third air supply passage 12*c* is bent upward, a wall surface of the mouthpiece section 2 covering the third air supply passage 12*c* extends upward. Since this wall surface functions as a stopper for the upper lip 21, even if the whistle has to be held in mouth on the instant and be blown, the sound emitting openings 16*a*, 16*b*, 16*c* are not blocked with mouth and can be blown in a stable state.

Having described and illustrated the principles of this application by reference to one preferred embodiment, it should be apparent that the preferred embodiment may be modified in arrangement and detail without departing from the principles disclosed herein and that it is intended that the application be construed as including all such modifications and variations insofar as they come within the spirit and scope of the subject matter disclosed herein.

What is claimed is:

1. A whistle comprising:

an air supply opening through which a breath is blown into;

a first resonance chamber, a second resonance chamber and a third resonance chamber into which the breath blown into through the air supply opening flows through a common air supply passage, as well as a first air supply passage, a second air supply passage and a third air supply passage that branch from the common air supply passage; and a first sound emitting opening, a second sound emitting opening and a third sound emitting opening that emit sounds generated in the first resonance chamber, the second resonance chamber and the third resonance chamber, respectively; wherein a diameter of the first resonance chamber, a diameter of the second resonance chamber, and a diameter the third resonance chamber are identical, and a length of the first resonance chamber, a length of the second resonance chamber and a length of the third resonance chamber are different from one another, the first resonance chamber and the second resonance chamber are arranged side by side in a planar view, the third resonance chamber is disposed between the first resonance chamber and the second resonance chamber, as well as upside the first resonance chamber and the second resonance chamber, and the first resonance chamber, the second resonance chamber and the third resonance chamber are arranged in such a way that respective central axes in a longitudinal direction of the first resonance chamber, the second resonance chamber and the third resonance chamber form an approximately upright triangle, the third air supply passage is bent upward and extended to the third resonance chamber, and the outlet of the third air supply passage is disposed ahead of the outlet of the first air supply passage and the outlet of the second air supply passage, and the first sound emitting opening, the second sound emitting opening and the third sound emitting opening are open upward.

* * * * *